United States Patent [19]

Tisma

[11] Patent Number: 4,713,928

[45] Date of Patent: Dec. 22, 1987

[54] AUTOMATIC PACKAGING MACHINE FOR CLOSING OVER FILLED BOXES

[75] Inventor: Steven Tisma, Chicago, Ill.

[73] Assignee: Tisma Machine Corporation, Chicago, Ill.

[21] Appl. No.: 905,705

[22] Filed: Sep. 9, 1986

[51] Int. Cl.[4] ..... B65B 35/38; B65B 61/24

[52] U.S. Cl. ..... 53/526; 53/148; 53/377; 53/538

[58] Field of Search ..... 53/526, 436, 377, 502, 53/537, 538, 148; 100/229 A, 63

[56] References Cited

U.S. PATENT DOCUMENTS

| | | | |
|---|---|---|---|
| 2,276,541 | 3/1942 | Howard | 53/526 |
| 2,481,611 | 9/1949 | Moore | 53/526 X |
| 2,714,792 | 8/1955 | Wright et al. | 53/526 |
| 2,821,827 | 2/1958 | Shaw et al. | 53/526 |
| 2,927,412 | 3/1960 | Hayes et al. | 53/526 X |
| 3,292,341 | 12/1966 | Frost | 53/538 X |
| 3,895,479 | 7/1975 | Kastner | 53/148 |

*Primary Examiner*—James F. Coan

*Attorney, Agent, or Firm*—Laff, Whitesel, Conte & Saret

[57] ABSTRACT

An automatic packaging machine includes a loading station for simultaneously and sequentially picking up a plurality of elongated products and deposing them in a spaced parallel alignment within a box. At the time of loading each of the products has an initial volume which is substantially greater than the volume which the same product will have after it has settled over time within the box. Thus, the box id overfilled by an amount which will make it full after the products have settled. Then, the overfilled box is advanced to a closing station, where the lid is closed over the filled box without damage to the products. This immediately reduces the volume of the products to the volume which they would have after they have settled.

10 Claims, 9 Drawing Figures

AUTOMATIC PACKAGING MACHINE FOR CLOSING OVER FILLED BOXES

This invention relates to automatic packaging machines, and more particularly to machines for packaging many products which have an initial volume when packed that is greater than the volume of the box in which they are packed, but which settle within the box to a much smaller volume.

By way of example, plastic sleeves containing medical syringes for giving shots illustrate a product which may be packaged on the inventive machine. Each syringe is encased and sealed in a soft plastic sleeve or wrapper to protect and keep it sterile. As manufactured, the plastic wrappers have a relatively large diameter which give them an initially large volume; however, as they set in a box, the wrappers tend to become compressed so that, after a period of time, their volume reduces substantially. If their outer box is large enough to hold the initial volume of the syringes, before they settle, the manufacturer would have to pay more than he should to ship and store empty space within the box. On the other hand if the box is as small as it could be after the syringes settle and their plastic wrappers compress, it is very difficult to load and close the boxes in an automatic machine.

Another problem is that, during packaging, it is necessary to convey the syringes to and then put them into the box. If they are simply dumped into the box without any care and alignment, they will occupy even more space. Then the acts of closing, shipping and handling the box might move the plunger and expell some medicine from the syringe, leaving a shot with a non-standard amount of medicine, which would be detrimental to the patient who receives the shot. On the other hand, if a pick up device is used in order to place the shot packages in layered alignments within the box, it might be possible that the pick up device will fail to grasp every syringe, leaving too few syringes in the box. Or if they over lay each other, a plurality of syringes might be grasped by one pick up device, resulting in too many syringes in the box. Thus, there is a difficult problem of how to get an exact number of the syringes into a box with an exact alignment which compress properly as the lid of the box is closed.

Of course, syringes are only one of many examples of products which may be packaged by the invention. Therefore, the term "product" will be used hereinafter to generically include all suitable products.

Accordingly, an object of this invention is to provide new and improved automatic packaging machines. Here an object is to provide machines which are able to place products in a box which may be closed when the products initially have a volume which is much greater than the volume enclosed by the box.

Another object of the invention is to provide automatic packaging machines which are able to pick up and package syringes and which insure a completely accurate count.

Still another object of the invention is to place the syringes in the box in a manner which protects them from loss of medicine. Here, an object is to prevent a movement of the plunger to expel some of the medicine responsive to a closing of the box.

Yet another object of the invention is to provide an automatic machine which may close the top on an over filled box.

In keeping with an aspect of the invention, these and other objects are accomplished by an automatic packaging machine comprising a loading station for simultaneously and sequentially picking up a plurality of products and depositing them in a spaced parallel, layered alignment within a box. When picked up, each of the products has an initial volume which is substantially greater than the volume which the product will have after it has settled over time within said box. Therefore, the packaging machine overfills the box at the loading station, so that it will be full after the products have settled. The over filled box is then advanced to a closing station, where a lid is close on the over filled box without damage to the product. Thus, the volume of the products is immediately reduced to the volume which they would have after they have settled.

A preferred embodiment of the invention is shown in the attached drawings, wherein.

Figure 1:
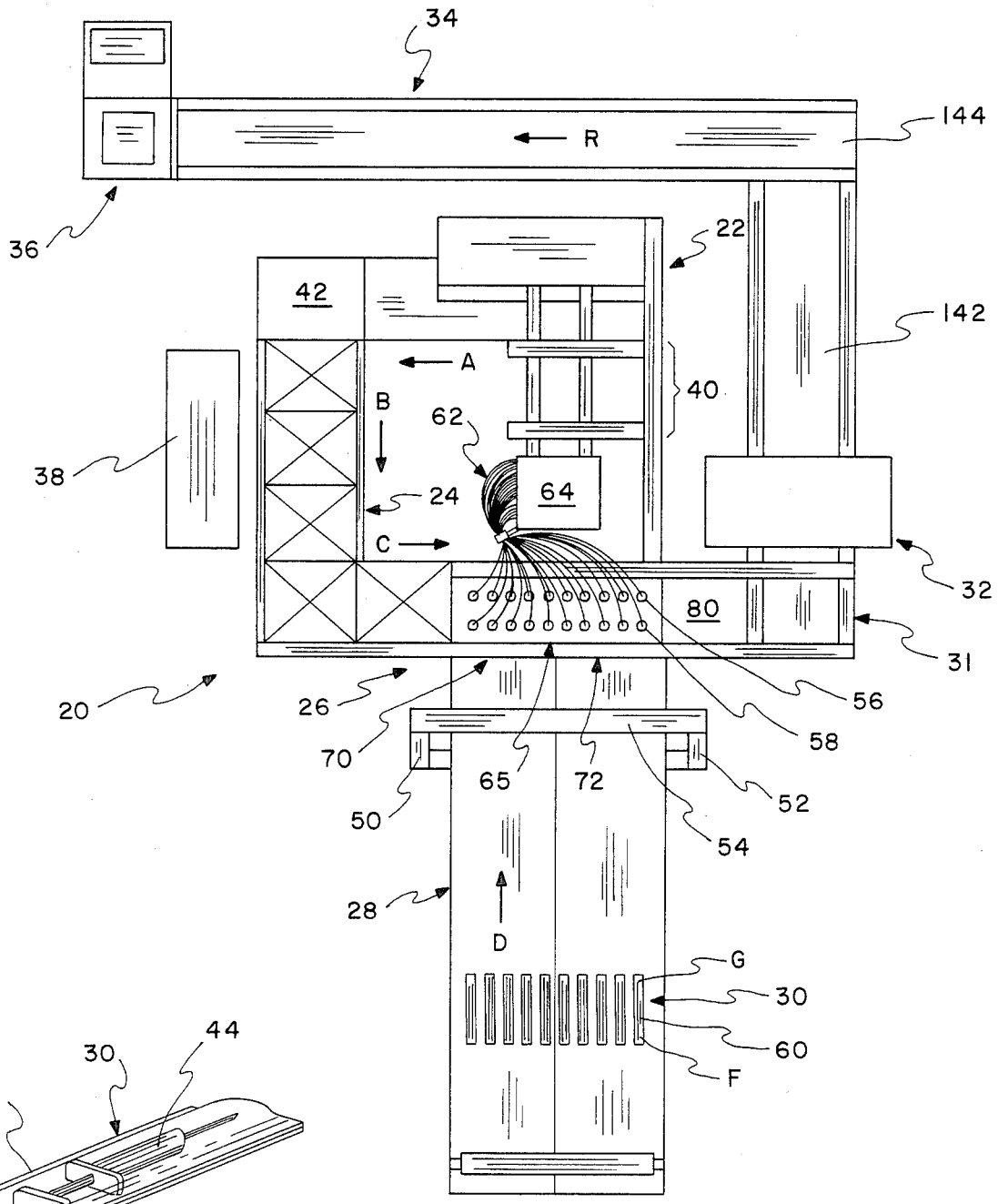
FIG. 1 is a top plan view of the inventive automatic packaging machine.

The major parts of the inventive automatic packaging machine 20 (FIG. 1), are a box fold and form station 22, a conveyor 24 for moving the formed boxes to a loading station, a loading station 26, a conveyor 28 for bringing in the product 30 arranged in successive rows, with the products in a spaced parallel alignment within the rows, a conveyor 31 for moving an over filled box to a closing station 32, an output conveyor 34, and a scale 36 for weighing a full box to insure that an accurate product count is enclosed therein. A control cabinet 38 includes a microprocessor for operating the packaging machine.

The box folding and forming station 22 begins with a plurality of blanks stacked in a magazine at 40, which are picked up one at a time, folded and formed into individual boxes. This station may use any suitable and well known equipment. Therefore, there is no need to describe it further.

The formed boxes (one of which is seen at 42) move out of the forming station 22 and are caried by conveyor 24 over a path represented by arrows A-C. The boxes have their top side open so that the viewer of FIG. 1 is looking down and into empty boxes in the area of conveyor 24. Each box has two upstanding and opposing end flaps and an upstanding top flap, which fold over the top to close the box. Since this conveyor is any suitable and well known device, there is no need to describe it further.

Figure 1A:
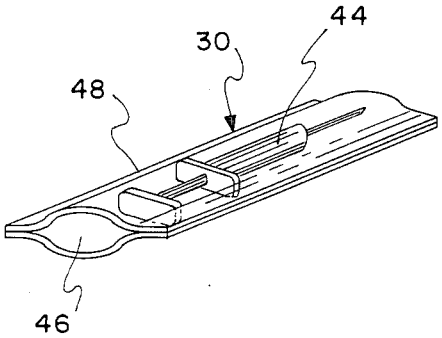
FIG. 1A shows a product (here a syringe) which might be packaged by the machine.

By way of example, a single product 30 is shown in FIG. 1A as a syringe 44 inside a plastic wrapper 46. The syringe is filled with an exact amount of medicine and sealed inside the plastic wrapper. Then the package is sterilized, after which the plastic wrapper keeps the product sterile until it is used. At the time of manufacture, the air entrapped inside the wrapper 46 tends to hold it in a rather large volume configuration. As the product lays in the box under its own and the weight of all of the other products resting on it, the plastic wrapper 46 tends to be compressed, and its volume is reduced. It is important for the product to reach the user without having the plunger 48 moved in even the slightest amount. The machine for sealing the product within wrapper 46 is any suitable and well known device.

After the product is wrapped and sterilized, it is delivered to the conveyor 28 where a suitable number (such as ten) products are laid down in successive rows of spaced parallel alignment across the width of a conveyor belt, one of such rows being shown at 30 in FIG. 1.

The travel of the product 30 down conveyor 28 and into the pick up area 26 is controlled by sensors 50, 52 which start and stop the conveyor 28 in coordination with the pick up sequence. Just before the pick up sequence begins a sensor 54 determines that all ten product are present in row 30 and in approximately the correct position. Each of these sensors may be a combination of a light source and a photo cell.

The pick up device 26 comprises two cooperating vacuum cups, per product, which cups are longitudinally disposed relative to the aligned length of the product. For example, the cooperating pair of vacuum cups, 56, 58 engage the opposite ends E, F of the right-hand procuct 60. Each cooperating pair of adjacent vacuum cups is in an alignment which is the same as the spaced parallel alignment of the adjacent products in row 60. A number of tubes 62 individually couple each of the vacuum cups to a vacuum chamber 64. If the vacuum cups fail to pick up a product, it remains on conveyor 28 until it is swept away by a fence (not shown), into a pile which will be used to complete the filling of boxes which are found to have a short count at output station 36.

Figure 2:
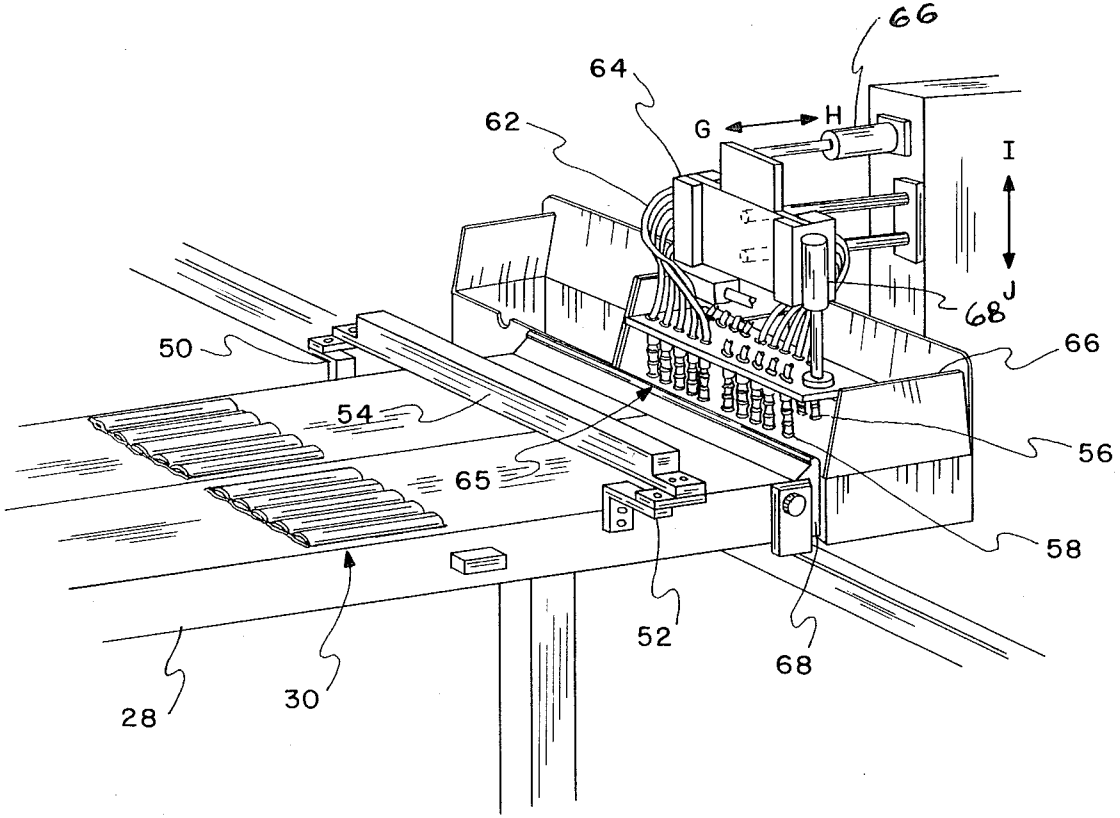
FIG. 2 is a perspective view of a loading station where the products are picked up and put into a box.

A first pneumatic cylinder 66 (FIG. 2) moves the vacuum cups 65 forward (Direction G) or back (Direction H). A second pneumatic cylinder 68 raises and lowers the vacuum cups, (Direction I and J). At the foreward and lower extremity of the motion controlled by these two cylinders, each cooperating pair of the vacuum cups is in engagement with a corresponding one of the products. Then a vacuum is drawn to pick up that product. While the vacuum is being held, the two cylinders 66, 68 raise and retract the product to a position over an empty box. Next, vacuum is released. A first layer of the product is laid into the box, with the individual products in the same alignment that they had on conveyor 28. In the embodiment of FIG. 1, two boxes at 70, 72 are filled simultaneously at one time so that one-half of the products in row 60 is dropped into each box (i.e. there are five syringes in each layer in each of the boxes 70, 72).

After each layer is placed in a box, the conveyor 28 advances by a distance equal to the length of a product, as detected by the sensors 50–54. Then, the vacuum cups are driven through another sequence and another row of the aligned product is picked up and laid down as the next layer in the boxes. Thus, the products are laid down layer upon layer, in the box, with all product aligned in a spaced parallel relationship so that no pressure is applied to move the plunger 48 (FIG. 1A) of the syringe.

As should be apparent from FIG. 1A, the plastic wrapper 46 initially encompasses a volume which is much larger than the volume of the product. Therefore, as the layers of product 74 (FIG. 3) accumulated within the box 76, they occupy much more than 100% of the total volume of the box, the piled up layers raising above the upper level of the box, and between a pair of upstanding and opposing end flaps 102, 104, and a top flap 110. The box 76 (FIG. 3) is shown resting in position 80 of FIG. 1, as it approaches the box closing station 32.

Figure 3:
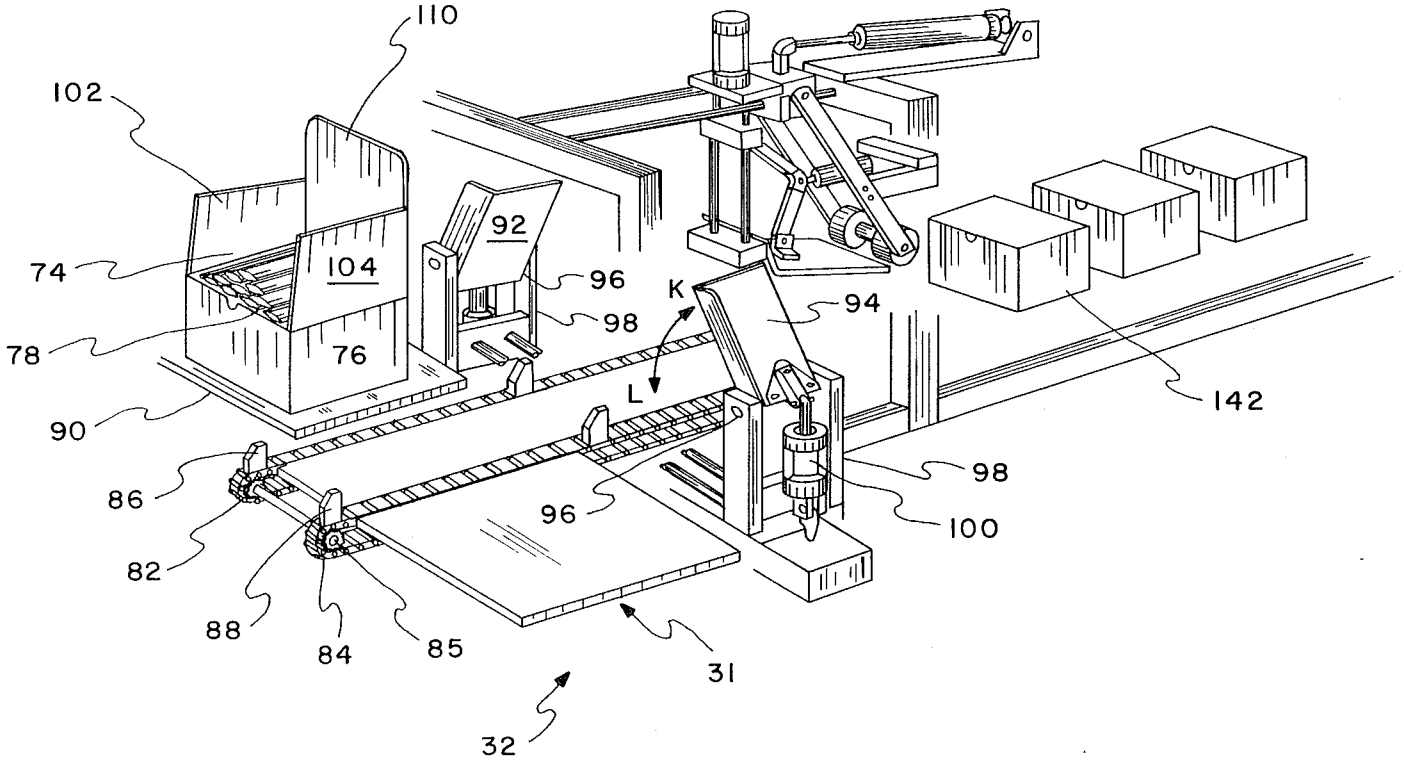
FIG. 3 is a perspective view of an over filled box approaching a box closing station.
Figure 4:
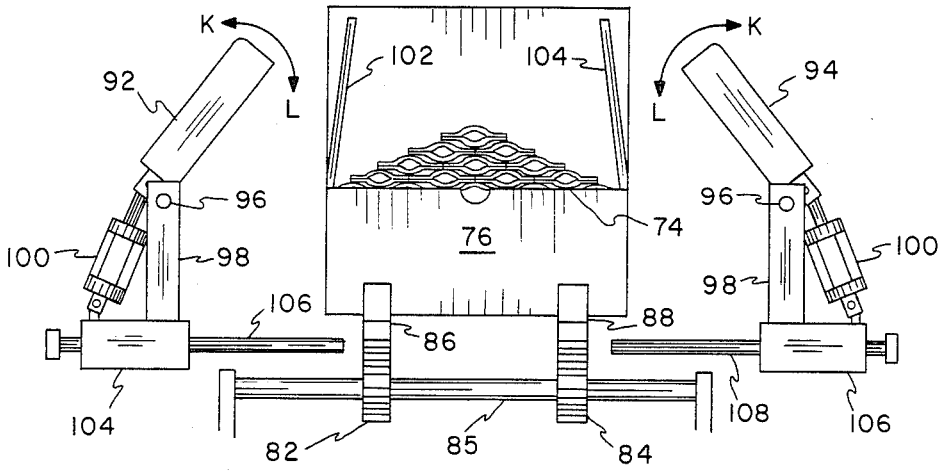
FIGS. 4–8 are five stop motion views showing the box closing sequence.
Figure 5:
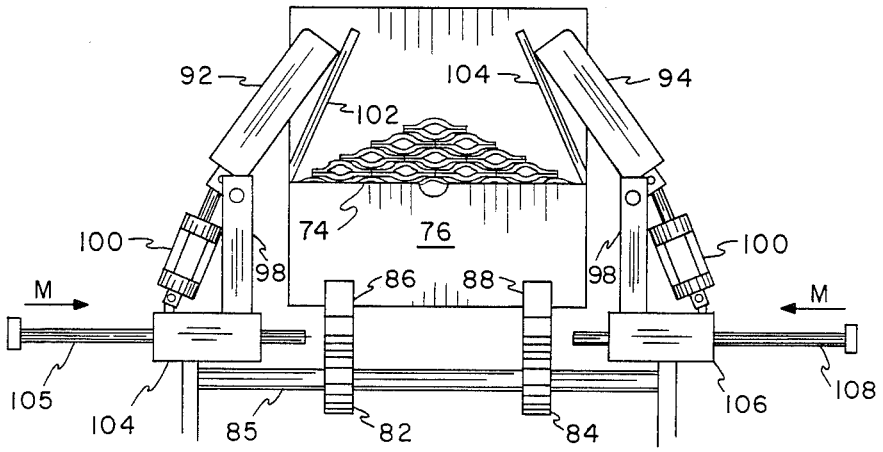

The closing station has two spaced parallel conveyor chains 82, 84 which are driven in synchronism by two sprocket wheels affixed to a common shaft 85 (FIGS. 4–5). The chains 82 and 84 are link or bicycle chains. Pushers 86, 88 are attached at fixed intervals along the length of the two chains, the interval being long enough to receive a single box, such as 76. Thus, conveyor 90 (FIG. 3) moves the box 76 in front of the pushers 86, 84 (FIG. 4) which, in turn, move it forward to a position between two paddle-like members 92, 94.

Each paddle-like member is pivotally supported on an upright support 98 by a hinge pin 96. A pneumatic cylinder 100 raises and lowers the paddle-like members, swinging them over an arc K, L. Thus, the paddle-like members 92, 94 function somewhat as if they were two open hands pushing flaps 102, 104 down and over the pile 74 of products which are over filled into the box. Since all of the layers have the product in the same spaced parallel relationship, they are not damaged, and in particular, there is no danger that plunger 48 (FIG. 1A) may be moved by this action of members 92, 94.

Two pneumatic cylinders 104, 106 (FIG. 5), move the paddle supports 98, 98 toward the box 96, in directions M, with movement being along guide rails 105, 108. As shown in FIG. 5, the paddle-like members 92, 94 are touching flaps 102, 104 and are in a position to close them.

Figure 6:
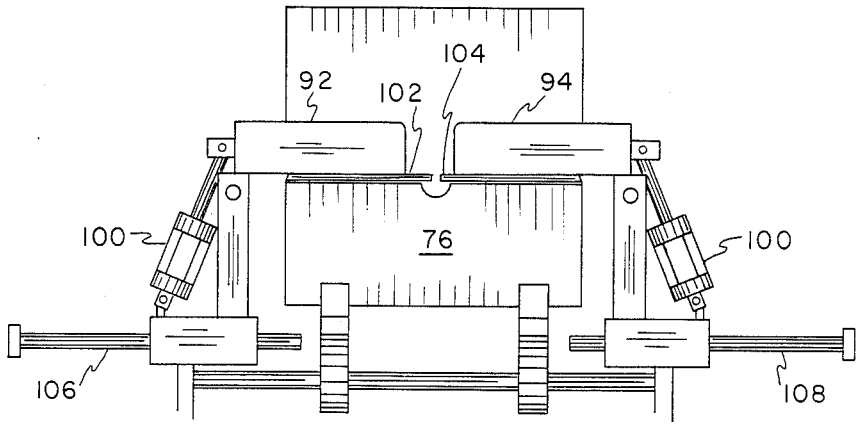

The two pneumatic cylinders 100, 100 operate (FIG. 6) and the flaps 102, 104 are closed, pushing down the entire pile 74 of over filled product so that it is completely enclosed within the box 76.

Figure 7:
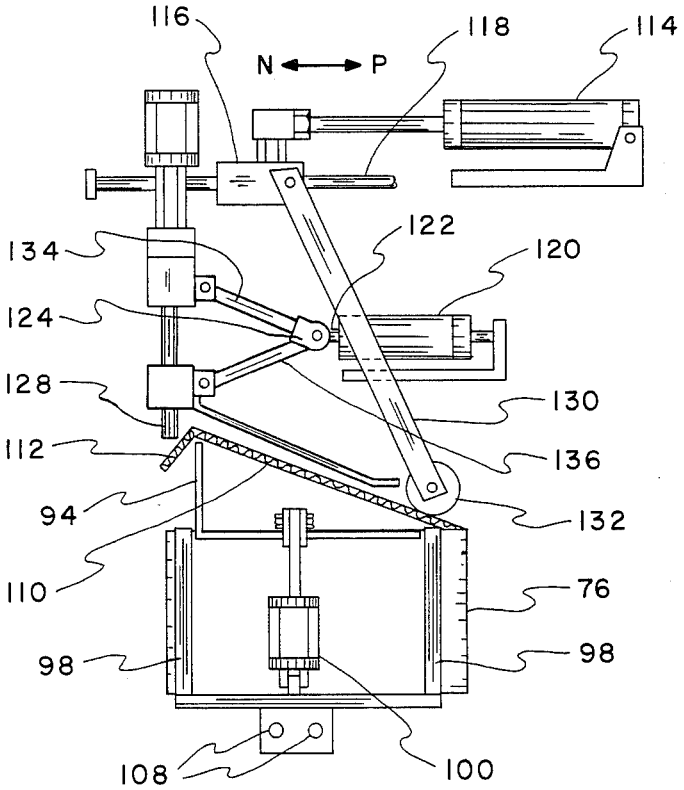

As best seen in FIG. 7, each of the paddle-like members 92, 94 has a somewhat L-shaped cross section, with the tip of the upstanding leg of the "L" striking the top 110 of the box along a fold line between it and a tuck flap 112.

A pneumatic cylinder 114 slides a superstructure member 116 back and forth (Directions N, P) on rail 118. Pneumatic cylinder 120 controls the position of a pivot point 124 between two lever arms 134, 136, thus raising and lowering a tuck plate 128. As shown in FIG. 7, the structure 116 is being pushed forward, (Direction N), moving the roller 132 in Direction Q, over the top of box 76. Thus, the movement of structure 116 brings the tuck plate 128 into a position which bears against tuck flap 112, in order to fold it over member 94 and into a tuck position. The paddle like members 92, 94 are holding down the opposing end flaps 102, 104 at the time when the tuck plate 128 operates, and while roller 132 on the lower end of a bar 130, bears against and closes lid 110.

Figure 8:
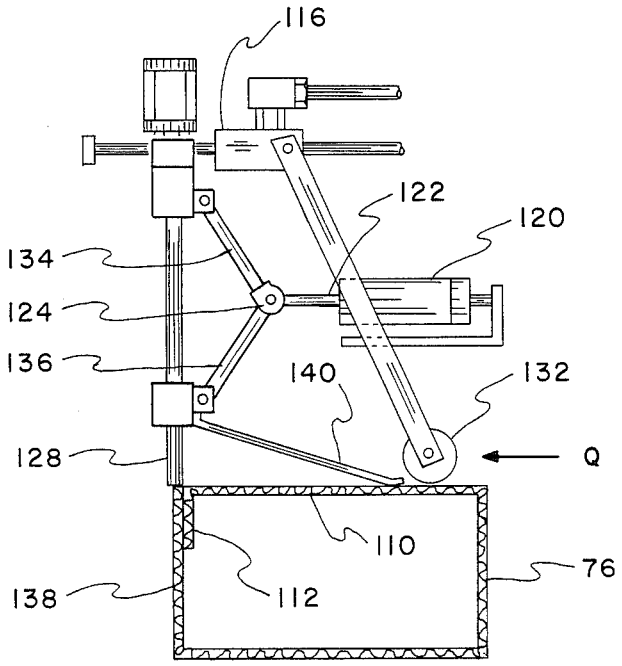

Next, the pneumatic cylinder 120 is operated (FIG. 8) and the plunger arm 122 is extended so that lever arms 134, 136 straighten and blade 128 presses tuck flap 112 into place behind front panel 138 of the box 76. At the same time a panel 140 pushes down upon the lid 110 of the box. Simultaneously and synchronized with this operation, the pneumatic cylinders 104, 106 (FIG. 5) retract the paddle-like members 92, 94 which return to the position shown in FIG. 4 so that the lid 110 may close completely. When these paddle-like members 92, 94 reach the position shown in FIG. 4, the pneumatic cylinders 100 raise them to a raised position (Direction K).

The lid is now closed and, therefore, cylinder 114 (FIG. 7) retracts (Direction P) the structure 116 while conveyor chains 82, 84 (FIG. 3) remove the box and roller 132 moves back rolling over lid 110 to be sure that box 76 is fully closed.

The box is now closed. Conveyor chains 82, 84 (FIG. 3) move the box out of the closing station 32 as the next open and over filled box moves up (from the position of 76 in FIG. 3) to be closed. The closed box has now moved to position 142 (FIGS. 1, 3). As the boxes continue to be filled, each newly closed box advances to enter conveyor 34 at position 144. From there, it moves down conveyor 34 in direction R, moving the length of one box each time that another box has been closed in station 32.

Since the particular example of FIG. 1 shows two boxes being filled simultaneously at stations 70, 72, and since the closing can be accomplished in no more and probably less than half the time required to fill the two boxes, the conveyor chains 86, 88 and conveyor 34 run at a speed wherein two boxes are closed in sequence during the interval while two boxes are being filled simultaneously at station 26.

When the filled boxes reach the scale 36, at the end of conveyor 34, they are weighed. If the box contains exactly the correct number of products, it will pass the weight test and be carried off to an appropriate area, by a conveyor not shown.

If the box contains more or less products than it should contain, the scale 36 is over or under the correct weight and the incorrectly filled box is diverted to a manually controlled work station. If desired, the scale may read out the weight in terms of the incorrect count. For example, the scale might indicate "add 2" or "remove 1", or whatever the correct instruction might be. Regardless of how the scale is arranged, the workman opens the box and, adds or removes products. Thus, the number of products which are added to or removed from any given box depends upon the weight of that given box.

Those who are skilled in the art will readily perceive how to modify the invention. Therefore, the appended claims are to be construed to cover all equivalent structures which fall within the true scope and spirit of the invention.

The claimed invention is:

1. An automatic packaging machine comprising a loading station means for simultaneously and sequentially picking up a plurality of elongated products and depositing them in a spaced parallel alignment within a box, when picked up each of said products having an initial volume which is substantially greater than the volume which the same product will have after it has settled over time within said box, whereby said box needs to be overfilled at said loading station so that it will be full after said products have settled, said box having a pair of opposed end flaps which are large enough to at least jointly cover the space through which said products are inserted into the box, means for advancing said over filled box to a closing station, means for thereafter closing a lid of said box without damage to said over filled products, immediately reducing the volume of said products to the volume which they would have after said products have settled, said closing means comprising a pair of pivoted paddle-like members which swing over and close said end flaps to press said overfilled products into said box, means for thereafter folding a top flap over said box and tucking an end of said top flap therein, each of said paddle-like members having a generally L-shaped cross section with a small end of said L-shape projecting upwardly toward said end of said top flap, and means for folding an end of said top flap over said small end of said L-shape in order to form said end of said top flap into a tuck flap.

2. The automatic packaging machine of claim 1 wherein each of said paddle-like members is mounted on at least one individually associated guide rail extending toward said box, means for moving said paddle-like members along said guide rails toward and away from said box, means for thereafter pivoting said paddle-like members to swing over the end flaps and to close said box, said means for folding said top flap thereafter operating to form said tuck flap at the end of said top flap, and means for withdrawing said paddle-like members while said tuck flap is being pressed into said box.

3. An automatic packaging machine comprising a magazine of blanks, a box folding and forming station for converting said blanks into boxes having at least a pair of opposed upstanding end flaps and an upstanding top flap, first conveyor means for transporting said formed boxes to a loading station, means at said loading station for depositing products into said box to provide an initially over filled volume of products which is greater than the volume of said box, said overfill raising the level of the products above the box and in the space defined by said upstanding end flaps and top flap, second conveyor means for transporting said overfilled boxes to a closing station, means at said closing station for folding said end flaps over said overfill level of products and pressing said products into the box, means for closing said top over said folded end flaps, and third conveyor means for transporting said closed boxes to an output station.

4. The automatic packaging machine of claim 3 and means at said output station for detecting the number of products in each filled box, whereby boxes with a non-standard number of products packed therein may be diverted for correction.

5. The automatic packaging of claim 4 wherein said detecting means is a scale for weighing said filled box.

6. The automatic packaging machine of claim 3 wherein each of said products is a syringe in a plastic sleeve wrapper, and a fourth conveyor for transporting to said loading station, a predetermined number of said syringes in spaced parallel alignment within successive rows said loading station comprising a plurality of vacuum cups poised over said syringes in said spaced parallel alignment, whereby said vacuum cups may be moved to pick up said syringes and load them into said boxes.

7. The automatic packaging machine of claim 6 wherein said syringes in said plastic sleeve wrappers are elongated members in said spaced parallel alignment and formed into said successive rows, said plurality of vacuum cups being arranged in cooperating pairs of vacuum cups at physical locations corresponding opposite ends of said spaced parallel syringes when in said rows, means for successively moving said vacuum cups first over said syringes and then over said box for making a simultaneous pick up of a row of syringes, and means for cyclically repeating said movement of said vacuum cups for making a sequential pick up of successive rows of said syringes as they are presented to said box whereby successive layers of said syringes are deposited in said box by said vacuum means.

8. The automatic packaging machine of claim 3 wherein said pair of opposed end flaps are large enough to at least jointly cover the overfilled space, said closing means comprising a pair of pivoted members which swing over and close said end flaps while pressing said overfilled products into said box, and means for thereafter folding a top flap over said box and tucking an end of said top flap therein.

9. The automatic packaging machine of claim 8 wherein each of said pivoted member has a generally L-shaped cross section with a small end of said L-shape projecting upwardly toward said end of said top flap, and means for folding said end of said top flap over said small end of said L-shape in order to form said end of said top flap into a tuck flap.

10. The automatic packaging machine of claim 9 wherein each of said pivoted members is slidably mounted on at least one individually associated guide rail extending toward said box, means for moving said pivoted members along said guide rails toward said box, means for thereafter swinging said pivoted members over the end flaps and to close said box, said means for folding said top flap thereafter operating to form said tuck flap, and means for withdrawing said pivoted members while said tuck flap is being pressed into said box.

* * * * *